United States Patent [19]

Kister

[11] Patent Number: 4,629,484

[45] Date of Patent: Dec. 16, 1986

[54] PROCESS FOR SEPARATING HYDROGEN AND METHANE FROM AN ETHYLENE RICH STREAM

[75] Inventor: Henry Z. Kister, Huntington Beach, Calif.

[73] Assignee: C F Braun & Co., Alhambra, Calif.

[21] Appl. No.: 746,943

[22] Filed: Jun. 20, 1985

Related U.S. Application Data

[63] Continuation of Ser. No. 528,363, Aug. 31, 1983, abandoned.

[51] Int. Cl.[4] ..... F25J 3/02

[52] U.S. Cl. ..... 62/29; 62/31; 62/33; 62/34; 62/39

[58] Field of Search ..... 62/9, 11, 23–34, 62/38, 39; 208/351

[56] References Cited

U.S. PATENT DOCUMENTS 3,729,944 5/1973 Kelley et al. ..... 62/39

*Primary Examiner*—Frank Sever

*Attorney, Agent, or Firm*—Lyon & Lyon

[57] ABSTRACT

A process for separating hydrogen and methane from a gas mixture containing hydrocarbons heavier than methane in which the gas mixture is passed through a plurality of chilling stages, a bottoms portion from at least one of the chilling stages being passed to a hydrogen stripper before being introduced to a fractionating column, the hydrogen stripper overheads portion being passed back into the chilling train from which a final hydrogen rich stream containing in excess of ninety mole percent hydrogen is separated at a temperature lower than −140° C.

21 Claims, 1 Drawing Figure

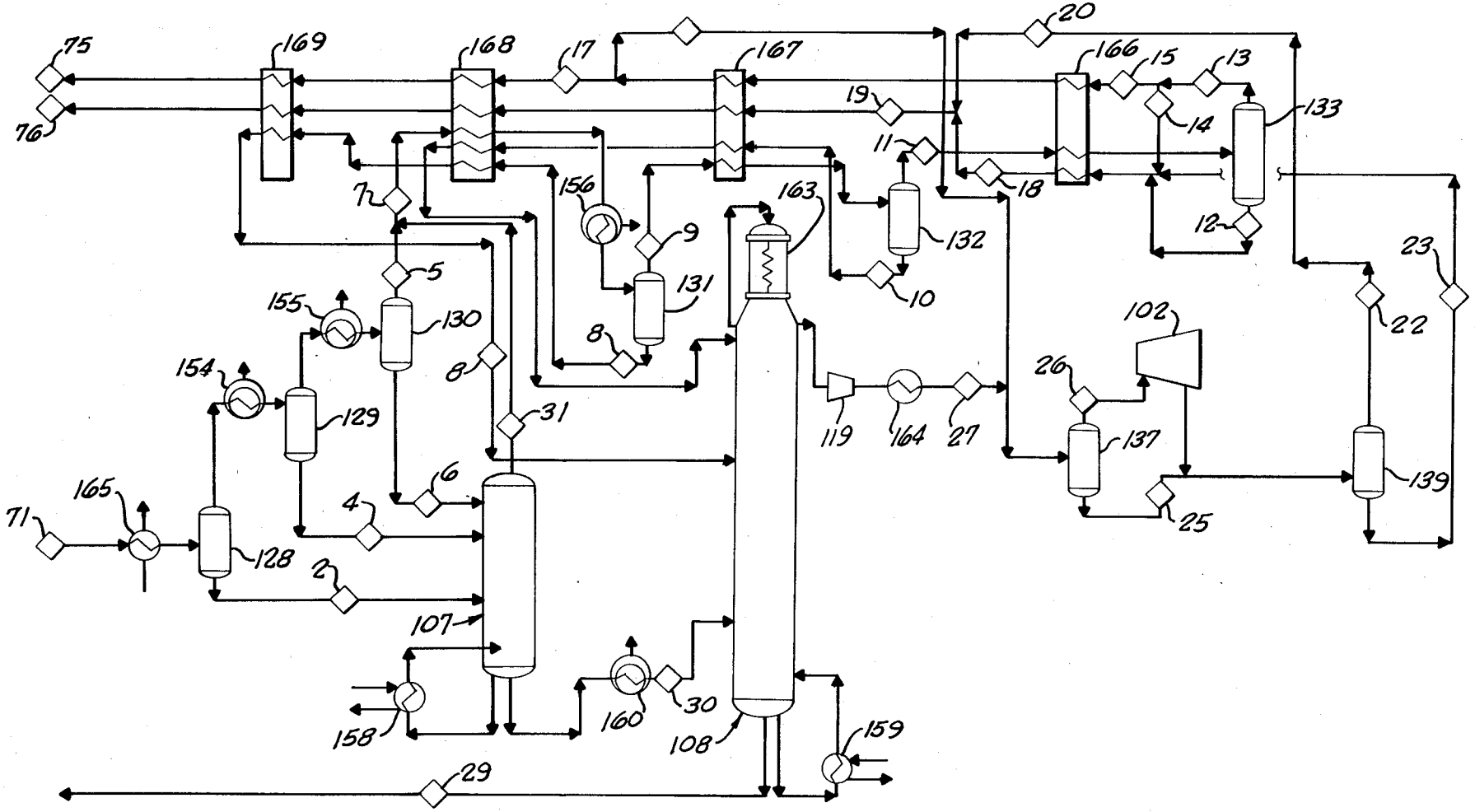
23
22
139
133
13
12
14
15
166
102
25
137
26
20
18
132
10
11
19
27
164
119
163
159
167
108
9
131
30
160
156
8
17
31
168
8
130
6
5
7
107
158
29
169
155
129
4
2
154
128
165
75
76
71

PROCESS FOR SEPARATING HYDROGEN AND METHANE FROM AN ETHYLENE RICH STREAM

This application is a continuation of application Ser. No. 528,363 filed Aug. 31, 1983 abandoned.

BACKGROUND OF THE INVENTION

1. Field of the Invention

This invention relates to a process for separating the low boiling components from a gaseous mixture of hydrogen and hydrocarbons, and in particular, to a process for demethanization in which a high recovery of relatively pure stream of hydrogen off-gas is obtained.

2. Description of the Prior Art

Ethylene is an important chemical in the petrochemical industry, particularly in the production of polymers. Ethylene may be obtained through separation processes from hydrocarbon mixtures which are derived from various sources such as normal refinery operations, cracking processes and the like. The content of the hydrocarbon mixture containing ethylene will vary depending upon the source of the hydrocarbon mixture. However, it is typical that a hydrocarbon mixture used in an ethylene production plant will include hydrogen, methane, ethane, ethylene and other higher hydrocarbons.

In general, the process of removing the methane and the hydrogen, referred to as demethanization, will usually be the single most expensive step in separating ethylene from the original hydrocarbon feed mixture. The expense associated with demethanization is a result of the low temperature requirement of this step and the vapor liquid equilibrium of the methane-ethylene system. A good discussion of demethanization as well as other processes utilized in the complete process of separating ethylene from an initial hydrocarbon feed mixture is given in King, *The Low Temperature Separation of Hydrocarbons,* Trans. Instn Chem. Engrs., Volume 36, page 162, 1958, the disclosure of which is hereby specifically incorporated by reference. Although steps such as depropanization and ethylene-ethane separation will be required before ethylene can be separated from typical hydrocarbon feed mixtures, this invention is primarily concerned with demethanization.

During all demethanization processes, hydrogen and methane must be removed from the hydrocarbon gas mixture. Often, there is economic incentive to recover as much of the hydrogen as possible as a relatively pure stream of at least 90% purity. This hydrogen stream can then be utilized as a chemical feed stock for other processes.

In early designs, simple demethanizers were used in which the total hydrocarbon mixture was chilled and fed to the demethanizer. This is the type of system described by King in the above reference. Such a system featured high ethylene losses because all the hydrogen flowed through the demethanizer. The ethylene loss is set by the dew point temperature that can be achieved by the overhead. To recover some of the ethylene, some of the demethanizer overhead was recycled through the plant, thus increasing equipment sizes and energy consumption.

Modern designs use a separator at each stage of chilling. The bottoms from each chilling stage separator is fed into a multifeed demethanizer. The uncondensed overheads stream from the last chilling stage contains most of the hydrogen in the initial hydrocarbon mixture. This hydrogen-rich gas bypasses the demethanizer, thus improving ethylene recovery and eliminating the need for plant recycles.

This system lends itself to hydrogen recovery from the hydrogen-rich gases. However, even with this system, some hydrogen still enters the demethanizer, ends up in the demethanizer overheads stream and is difficult to recover. In an ethylene plant using ethane feedstock, the demethanizer overheads stream typically contains around 10 mole percent hydrogen.

To obtain a high-purity hydrogen stream, the hydrogen-rich stream from the final feed chilling stage is cooled and sent to the hydrogen separator which operates at a temperature typically lower than −140° C. To obtain this low temperature, the methane-rich stream from the demethanizer overheads is expanded to a low pressure, thus generating the "deep cold" conditions required for high-purity hydrogen separation. When it is economical to achieve a high recovery of hydrogen, a significant portion of the methane-rich stream needs to be condensed to provide the required low temperature refrigeration.

The recovery of hydrogen from a demethanization system is limited by several factors. First, some hydrogen enters the demethanizer and ends up in the methane-rich stream. Since this stream contains only a small quantity of hydrogen, and since it is collected at low pressure, it is usually difficult and uneconomical to recover hydrogen from it. Second, the presence of hydrogen in the methane-rich stream as it comes off the demethanizer hinders condensation of this stream. This limits the amount of "cold" that can be obtained from expanding the methane-rich stream. Furthermore, the low vapor pressure of methane at the low temperatures needed for the hydrogen-methane separation requires that the methane liquid be vaporized at a low partial pressure in order for the methane-rich stream to provide the required refrigeration. This low partial pressure is provided by bleeding significant quantities of hydrogen-rich gas into the methane-rich stream.

The above factors reduce the quantity of hydrogen that can economically be recovered from the demethanization step. This problem is most severe when the ratio of hydrogen to methane in the process gas mixture is high.

Three conventional alternative methods may be utilized to enhance hydrogen recovery. All three increase the availability of "cold" required for the hydrogen separation, thereby reducing the quantity of hydrogen bleed required, but none of these recovers the hydrogen from the methane rich gas. In an ethylene plant cracking ethane feedstock, the hydrogen lost in the methane-rich gas is typically 4% of the total hydrogen in the process gas mixture. In addition, all these three methods have disadvantages, as described below.

One method utilizes an external methane refrigeration circuit. Such a system is expensive, both in capital and operating costs.

A second method compresses the methane-rich stream leaving the demethanizer overheads to a relatively high pressure, approximately 45 bars. This method involves a large compressor which utilizes a substantial amount of power and heats the compressed demethanizer overheads stream. The resultant heat must then be removed by the coldest level of ethylene refrigeration. An additional problem with this system is the difficulty in condensing reflux for the demethanizer. When insufficient reflux is available, there is an excessive loss of ethylene from the top of the demethanizer column, unless some additional reflux is condensed and separated at the overhead compressor discharge. Condensing reflux at the compressor discharge depends on a separation at temperatures and pressures which approach the critical too closely. Accordingly, such separation cannot be predicted with confidence.

A third method involves recycling expanded liquid back into the demethanizer. Recycling this stream represents a waste of energy and requires the use of cold pumps, which are an operating nuisance. By itself, this method can only provide a limited amount of cold, but it can be used in combination with the second method above.

Thus, there exists a need for a process of removing hydrogen and methane from a gaseous hydrocarbon mixture in which a high recovery of a relatively pure stream hydrogen is economically obtained without the need to utilize an external methane refrigeration circuit or the need to compress the methane-rich stream to high pressures.

SUMMARY OF THE INVENTION

In the present invention, a gaseous hydrocarbon feed mixture is cooled in a plurality of cooling stages and a bottoms portion from at least one cooling stage is introduced to a hydrogen stripper in which hydrogen is removed from the bottoms portion before the bottoms portion is introduced to a demethanizer fractionating column. In another aspect of the present invention, a relatively pure hydrogen stream is separated out in the demethanizer system.

When a gaseous hydrocarbon feed mixture is processed in accordance with the present invention, more of the hydrogen in the initial feed mixture is removed from the gaseous hydrocarbon mixture entering the demethanizer fractionating column. The resultant decrease in the hydrogen content in the demethanizer fractionating column overheads serves to enhance overall hydrogen recovery while enabling a satisfactory condensation of sufficient liquid to provide both sufficient cold for hydrogen separation and adequate reflux in the demethanizer to be achieved without the use of a large compressor or recycle streams. In addition, the loss of heavier hydrocarbons from the demethanizer fractionating column is minimized. In another advantage, this invention can be used to unload a demethanizer column and a demethanizer condenser, thus enhancing their capacity.

Accordingly, it is a primary object of the present invention to remove hydrogen which would otherwise have entered a demethanizer fractionating column and return it to a hydrogen separation system.

This and further objectives and advantages of the present invention will be apparent to those skilled in the art in connection with the following description of the preferred embodiment and accompanying drawing. It is to be understood that valves, pumps and the like have been omitted from the drawing to simplify the description thereof and the use of valves, pumps and other design equipment at appropriate places is deemed to be well within the scope of one skilled in the art.

DESCRIPTION OF THE DRAWING

FIG. 1 is a schematic diagram for a demethanization process in accordance with the present invention. DE-

TAILED DESCRIPTION OF THE PREFERRED EMBODIMENT

In the preferred embodiment of a process in accordance with the present invention, the cold fractionation begins with feed separation and chilling. The cold fractionation train consists of a deethanizer, a demethanizer, and an ethylene-ethane ($C_2$) splitter, not necessarily in this order. The function of the demethanizer system is to separate methane, hydrogen, and CO from the process gas stream. The main product is a stream which is passed from the demethanizer to a deethanizer or the $C_2$ splitter which contains $C_2$ and heavier hydrocarbons as well as 1000 ppm wt. methane or less and substantially no hydrogen or CO.

Referring now to FIG. 1, a stream 71 from a deethanizer net overhead is chilled in heat exchangers 165, 154 to 156 and in the cold-box exchangers 167 and 168. This chilling is carried out by exchange with successively colder levels of $C_3$ and ethylene refrigerant, and by exchange with cold-process streams. The stream 71 is passed to feed separators 128 through 132. The feed separators 128 through 132 may be flash drums in which the feed to each drum is separated into a liquid phase and a vapor phase. The liquid phase is collected as a bottoms portion while the vapor phase is collected as an overheads portion. The number of chilling stages and the chilling media used is a matter of design choice which one skilled in the art could vary without departing from the inventive concept described herein.

The bottoms portions 2, 4 and 6 in the chilling stages of the preferred embodiment are maintained at the highest temperatures and are passed to a hydrogen stripper 107. For the purpose of this invention, the hydrogen stripper 107 may be defined as a hydrogen fractionator containing at least a stripping portion. Although bottoms portions 2, 4 and 6 mostly contain hydrocarbons heavier than methane, they still contain an amount of hydrogen sufficient to affect the quantity condensed in the overhead of the demethanizer fractionation column 108 which contains a fractionation zone. For the purpose of this invention, the fractionation zone may contain a plurality of stripping stages, a plurality of rectifying stages or a plurality of stripping and rectifying stages.

Although the bottoms portions of the first three separators have been passed to the hydrogen stripper 107 in FIG. 1, the number of bottoms portions which are passed to the hydrogen stripper 107 may vary with the composition of the stream 71 and the economics of the plant. Thus, the number of feed separators, as well as the number of bottoms portions which are passed to the hydrogen stripper 107, may be varied by one skilled in the art, depending upon the tail process gas stream composition and the plant economics, so as to sufficiently reduce the amount of hydrogen which enters the fractionation column 108. It has been found that the feed to the hydrogen stripper 107 may be designed to reduce the percent of hydrogen found in the fractionation column overheads portion 27 to less than three moles percent while less than 100 ppm wt. hydrogen and less than 100 ppm wt. CO are found in the fractionation column bottoms portion 29.

In order to further facilitate an understanding of the present invention, the invention will be illustrated in the example that follows in which stream 71 consists of a deethanizer overheads portion and a material balance for the example is given in Table 1.

TABLE 1

| | MOL. WT. | 71 | 2 + 4 + 6 | 5 | 7 | 8 + 10 | 11 | 12 | 13 | 14 | 15 |
|---|---|---|---|---|---|---|---|---|---|---|---|
| CO KGMOL/H | 28.01 | 12.3 | 1.6 | 10.7 | 11.3 | 1.6 | 9.7 | 1.1 | 8.6 | 0.3 | 8.3 |
| $H_2$ | 2.016 | 1296.7 | 41.1 | 1255.6 | 1295.4 | 8.8 | 1286.6 | 2.3 | 1284.3 | 43.2 | 1241.1 |
| $CH_4$ | 16.04 | 451.3 | 141.0 | 310.3 | 323.5 | 189.6 | 133.9 | 78.5 | 55.4 | 1.8 | 53.6 |
| $C_2H_4$ | 28.05 | 1258.0 | 1054.1 | 204.0 | 213.6 | 212.6 | 1.0 | 1.0 | — | — | — |
| $C_2H_6$ | 30.07 | 974.3 | 905.8 | 68.6 | 71.9 | 72.0 | — | — | — | — | — |
| $C_3H_4$ (MA) | 40.06 | 0.1 | 0.1 | — | — | — | — | — | — | — | — |
| $C_3H_4$ (PA) | 40.06 | 0.1 | 0.1 | — | — | — | — | — | — | — | — |
| $C_3H_6$ | 42.08 | 6.8 | 6.8 | — | — | — | — | — | — | — | — |
| $C_3H_8$ | 44.09 | 0.4 | 0.4 | — | — | — | — | — | — | — | — |
| TOTAL KGMOL/H | — | 4000.0 | 2150.9 | 1849.2 | 1913.4 | 484.6 | 1431.1 | 82.9 | 1348.2 | 45.3 | 1302.9 |
| TOTAL KG/H | — | 75,095 | 59,505 | 15,589 | 16,232 | 11,231 | 5,040 | 1,318 | 3,723 | 127 | 3,596 |

| | 16 | 17 | 18 | 19 | 20 | 22 | 23 | 27 | 29 | 30 | 31 |
|---|---|---|---|---|---|---|---|---|---|---|---|
| CO KGMOL/H | 0.5 | 7.8 | 1.4 | 4.4 | 3.0 | 2.6 | — | 2.5 | — | 1.0 | 0.6 |
| $H_2$ | 74.1 | 1167.0 | 45.5 | 129.7 | 84.2 | 83.5 | — | 10.2 | — | 1.3 | 37.8 |
| $CH_4$ | 3.2 | 50.4 | 103.8 | 400.6 | 296.8 | 138.8 | 23.5 | 317.1 | 0.3 | 127.8 | 13.3 |
| $C_2H_4$ | — | — | 1.0 | 1.1 | 0.2 | — | — | 0.2 | 1257.0 | 1044.5 | 9.6 |
| $C_2H_6$ | — | — | — | — | — | — | — | — | 974.3 | 902.4 | 3.3 |
| $C_3H_4$ (MA) | — | — | — | — | — | — | — | — | 0.1 | 0.1 | — |
| $C_3H_4$ (PD) | — | — | — | — | — | — | — | — | 0.1 | 0.1 | — |
| $C_3H_6$ | — | — | — | — | — | — | — | — | 6.8 | 6.8 | — |
| $C_3H_8$ | — | — | — | — | — | — | — | — | 0.4 | 0.4 | — |
| TOTAL KGMOL/H | 77.7 | 1225.2 | 151.7 | 535.8 | 311.1 | 224.9 | 23.5 | 330.0 | 2239.0 | 2084.3 | 66.5 |
| TOTAL KG/H | 214 | 3,381 | 1,826 | 6,840 | 5,016 | 2,461 | 381 | 5,183 | 64,911 | 58,823 | 683 |

In the hydrogen stripper 107, most of the hydrogen contained in bottoms portions 2, 4 and 6 is collected as an overheads portion 31 while most of the methane and all but a fraction of the heavier hydrocarbons contained in bottoms 2, 4 and 6 are collected as a bottoms portion 30. The hydrogen stripper bottoms portion 30 preferably contains less than 5 percent of the hydrogen entering the hydrogen stripper and more than 70 percent of the methane entering the hydrogen stripper 107. As shown in FIG. 1, the bottoms portion 30 is passed through a heat exchanger 160 before introduction to the fractionation column 108. However, the inclusion of a heat exchanger 160 is a matter of design choice, which one skilled in the art could design without departing from the inventive concept described herein. The overheads portion 31 is combined with the overheads portion 5 from feed separator 130 and is passed to colder chilling stages in which additional bottoms portions 8 and 10 are generated and eventually fed to the fractionation column 108.

The overheads vapor 11 from the fifth demethanizer feed separator 132 is chilled and partially condensed in coldbox exchanger 166 to generate a hydrogen-rich gas stream 13 in the hydrogen separator 133. The operating temperature of the hydrogen separator 133 must be less than −140° C. to achieve a hydrogen stream of sufficient purity. In the present example, the hydrogen separator 133 is operated at −163° C. A portion 16 of this hydrogen-rich stream 13 may be combined with the fractionation column overheads portion 27 and passed into the tail gas expander system (described hereinafter) to provide the coolant required in order to achieve the hydrogen separation in the hydrogen separator 133. Another portion 14 of this stream may be combined with the bottoms portion 23 of the tail gas expander discharge separator 139 to provide the low temperature required at the hydrogen separator 133. The balance of stream 13 becomes the hydrogen-rich tail gas product stream 75 after its refrigeration energy is recovered from the cold-box exchangers 166 to 169.

Bottoms portion 12 from the hydrogen separator 133 contains mostly methane. After some of its refrigeration energy is recovered in the cold-box exchanger 166, it is combined with the tail gas stream 20 to form fuel stream 19 which is passed to the fuel-gas system as stream 76 after heat exchange with cold-box exchangers 167 to 169. Alternatively stream 20 can be injected into stream 12 upstream of cold-box exchanger 166.

Bottoms portion 8 from feed separator 131 is passed through cold-box exchangers 168 and 169 before being introduced to the fractionation column 108. Recycle streams from the hydrogen separator bottoms portion 12 and from the tail gas separator bottoms portion 23 may be recycled to the fractionation column 108 after heat exchange in cold-box exchangers 166 and 167.

The fractionation column 108 receives feeds from the hydrogen stripper bottoms portion 30 and from the bottoms portions of the demethanizer feed separators 131 and 132, streams 8 and 10. Stream 8 is passed through cold-box exchanger 168 and 169 before being introduced to the fractionation column 108. Stream 10 is passed through cold-box exchangers 167 and 168 before being introduced to the fractionation column 108. Either stream 8 or 10 or both may also be introduced to the fractionation column without passing through either or both exchangers.

The key separation in the fractionation column 108 is between $C_2$ and heavier components as a bottoms portion 29 and $C_1$ and lighter components as an overheads portion 27. The bottoms portion 29 leaving the fractionation column 108 comprises less than 1000 ppm wt. methane, less than 100 ppm wt. hydrogen and less than 100 ppm wt. CO. The overheads portion 27 comprises methane, hydrogen, CO and a small fraction of ethylene. Typical pressure at the overhead condenser 163 is set at 31 bar.

The fractionation column 108 overheads portion 27 is partially condensed in the demethanizer overhead condenser 163 using −101° C. ethylene refrigerant. The portion condensed is returned to the column as reflux. The vapor leaves the overhead condenser at 31 bar and −97° C. and is compressed by the demethanizer overhead compressor to a pressure typically 34 bar and a temperature of −86° C. This vapor is chilled and partially condensed in the demethanizer product condenser 164 using −101° C. ethylene refrigerant. The partially condensed stream is combined with the hydrogen bleed stream 16 and the mixture then flows into the tail gas expander separator drum 137. From this separator drum 137, some of the condensed liquid may be returned to the fractionation column 108 as reflux. The rest of the liquid is cascaded into the tail gas expander discharge drum 139 and is used to provide the "deep cold" refrigerant required for hydrogen separation.

In the present example, the overheads portion 27 contains 0.8% hydrogen, the balance being methane. Had the invention not been incorporated, the overhead would have contained approximately 11% hydrogen. The hydrogen is almost non-condensable. As condensation takes place in the product condenser 164, most of the condensate is methane and the hydrogen fraction in the vapor rapidly increases, which makes further condensation difficult. As the liquid condensed in the product condenser serves as refrigerant for hydrogen separation, the quantity of this refrigerant available is a prime function of the hydrogen fraction in the demethanizer overhead. The more hydrogen present in this stream, the less refrigeration is available for hydrogen separation in the hydrogen separator 133.

The fractionation column 108 may have one or more intercondensers which save energy by condensing the bulk of the column internal flows using the warmer refrigerant level instead of the colder, and therefore more expensive, −101° C. refrigerant used in the overhead condenser.

Reboil is supplied to the fractionation column 108 by a reboiler 159 by condensing $C_3$ refrigerant vapor. The bottoms portion 29 leaves the fractionation column 108 at −1° C. and 33 bar. It is then chilled before flowing to the $C_2$ splitter.

The expander system comprises a single or multiple stage expander 102, and a number of separators. The function of this system is to minimize ethylene losses to the tail gas stream 20 and to maximize refrigeration energy recovery.

The fractionation column overheads portion 27 leaving the demethanizer product condenser 164 combines with a portion 16 of the hydrogen separator 133 overheads portion and flows to separator 137. The vapor from the combined stream is fed into the expander where it is expanded to provide added liquid condensate. The liquid condensate along with the liquid from separator 137 is removed as a bottoms portion in separator 139. The bottoms portion flows into the tail gas heat recovery route. Some of the bottoms portion may be recycled to fractionation column 108 to increase ethylene recovery. The overheads portion 22 from the tail gas separator 139, which contains practically no ethylene, also enters the tail gas heat recovery route. This route consists of cold-box exchangers 166 through 169, where refrigeration energy is recovered. The tail gas which enters downstream of cold box exhanger 166 flows through the heat recovery and then flows into the dryer regeration system, and to the fuel-gas system. A tail gas compressor may be used to compress the tail gas to a pressure high enough to admit the gas into the fuel-gas system by way of dryer regeneration and cooling systems.

The tail gas exchanger system includes four cold-box exchangers 166 through 169. The main function of tail gas exchanger 166 is to chill and partially condense the overheads portion 11 from feed separator 132. Stream 11 is the feed to the hydrogen separator 133. The performance of this exchanger has a major bearing on both the purity of the product stream 75 as well as the ratio of vapor to liquid in the hydrogen separator 33. Chilling in cold-box exchanger 166 is provided by recovering the refrigeration energy from three sources. The first source is from the bottoms portion 23 of the tail gas separator 139 which flows into the tail gas. The second source is from the bottoms portion 12 from the hydrogen separator 133 which flows into the tail gas system. The third source is the bulk of the hydrogen separator 133 overheads portion 13.

The main function of the cold-box exchanger 167 is to chill and partially condense the overheads portion 9 from feed separator 131 which is the feed to feed separator 132. Chilling in cold-box exchanger 167 is supplied by recovering heat from the same three streams used in cold-box exchanger 166 above, and in addition, by recovering heat from feed separator 132 bottoms portion 10 which flows to fractionation column 108, and from the overheads portion 22 of the tail gas separator 139. The latter stream flows into the tail gas. Cold-box exchangers 168 and 169 recover additional refrigeration energy from the above and other cold streams. Cold-box exchanger 168 chills overheads portion 7 to feed separator 131 while cold-box exchanger 169 subcools refrigerant streams.

Although an expander-recompressor system is included in the design of the demethanizer system, the system may also be designed to operate when the expander is bypassed, with the same dry process gas feed rate, although in this case higher ethylene and ethane losses to the tail gas and hydrogen occur.

The maximum quantity of hydrogen-rich tail gas produced is determined by the cold available in the tail gases leaving the expander 102. The less cold available, the greater is the hydrogen bleed into the expander first stage separator 137 which is required to assist in generating this cold. This bleed represents a loss of hydrogen to the tail gas. The tail gas product leaves the system at a pressure equal to the fuel gas pressure plus the pressure drop through the dryer regeneration system.

Having fully described the present invention, it will be apparent from the above description and drawing that various modifications to the process described herein may be made within the scope of the invention. Thus, by way of example only, one skilled in the art could make various modifications in the expander-recompressor system as well as the chilling provided by the cold-box exchangers. Therefore, the invention is not intended to be limited except as may be required by the lawful scope of the following claims.

What is claimed is:

1. A process for separating hydrogen and methane from a gas mixture containing hydrocarbons heavier than methane, said process comprising the steps of:

providing the option of precluding the need to utilize an external methane refrigeration circuit by, passing the mixture through a plurality of chilling stages;

collecting at least one chilling stage bottoms portion from at least one of the plurality of chilling stages;

passing at least one chilling stage bottoms portion to a hydrogen stripper;

collecting a hydrogen stripper overheads portion containing most of the hydrogen entering the hydrogen stripper;

collecting a hydrogen stripper bottoms portion containing most of the methane and at least ninety-nine mole percent of the hydrocarbons heavier than methane passed to the hydrogen stripper;

passing the hydrogen stripper bottoms portion to a fractionation zone;

collecting a fractionation zone bottoms portion comprising at least ninety-nine mole percent of the hydrocarbons heavier than methane entering the fractionation zone and no more than one percent of the methane entering the fractionation zone;

collecting a fractionation zone overheads portion comprising mostly methane; and separating a hydrogen stream from at least one of the plurality of chilling stages operated at a temperature lower than −140° C.

2. A process as recited in claim 1 wherein the fractionation zone overheads portion contains less than one mole percent of the hydrocarbons heavier than methane contained in the gas mixture.

3. A process as recited in claim 1 wherein the fractionation zone bottoms portion contains less than 1000 ppm wt. methane, less than 100 ppm wt. hydrogen and less than 100 ppm wt. carbon monoxide.

4. A process as recited in claim 1 wherein the hydrogen stripper overheads portion contains at least ninety mole percent of the hydrogen passed to the hydrogen stripper and less than thirty percent of the methane passed to the hydrogen stripper.

5. A process as recited in claim 1 wherein the fractionation zone overheads portion contains less than three mole percent hydrogen.

6. A process as recited in claim 1 wherein the hydrogen stream is comprised of more than ninety mole percent hydrogen and contains at least ninety mole percent of the hydrogen contained in the gas mixture passed through the plurality of chilling stages.

7. A process as recited in claim 1 wherein the hydrogen stripper overheads portion is passed to at least one of the plurality of chilling stages.

8. A process as recited in claim 1 wherein the hydrogen stripper overheads portion is passed to a point upstream of the plurality of chilling stages.

9. A process for separating hydrogen and methane from a gas mixture containing hydrocarbons heavier than methane, said process comprising the steps of:

providing the option of precluding the need to utilize an external methane refrigeration circuit by, passing the mixture through a plurality of chilling stages;

collecting at least one chilling stage bottoms portion from at least one of the plurality of chilling stages;

passing at least one chilling stage bottoms portion to a hydrogen stripper;

collecting a hydrogen stripper overheads portion containing at least ninety percent of the hydrogen entering the hydrogen stripper;

collecting a hydrogen stripper bottoms portion containing at least seventy percent of the methane passed to the hydrogen stripper and at least ninety-nine mole percent of the hydrocarbons heavier than methane passed to the hydrogen stripper;

passing the hydrogen stripper overheads portion to at least one of the plurality of chilling stages;

passing the hydrogen stripper bottoms portion to a fractionation zone;

collecting a fractionation zone bottoms portion containing at least ninety-nine mole percent of the hydrocarbons heavier than methane, said fractionation zone bottoms portion containing less than 1000 ppm wt. methane, less than 100 ppm wt. hydrogen and less than 100 ppm wt. carbon monoxide;

collecting a fractionation zone overheads portion comprising at least ninety five mole percent methane; and collecting a hydrogen overheads portion from at least one of the plurality of chilling stages operated at a temperature lower than −140° C.

10. A process as recited in claim 9 wherein the hydrogen overheads portion is comprised of more than 90 mole percent hydrogen.

11. A process as recited in claim 9 wherein the hydrogen overheads portion contains at least 90% of the hydrogen contained in the gas mixture passed through the plurality of chilling stages.

12. A process as recited in claim 9 wherein the fractionation zone overheads portion contains less than three percent hydrogen.

13. A process for separating hydrogen and methane from a gas mixture containing hydrocarbons heavier than methane, said process comprising the steps of:

providing the option of precluding the need to utilize an external methane refrigeration circuit by, passing the mixture through a plurality of chilling stages;

collecting at least one chilling stage bottoms portion from at least one of the plurality of chilling stages;

passing at least one chilling stage bottoms portion to a hydrogen stripper;

collecting a hydrogen stripper overheads portion containing at least ninety percent of the hydrogen entering the hydrogen stripper;

collecting a hydrogen stripper bottoms portion containing at least seventy percent of the methane passed to the hydrogen stripper;

passing the hydrogen stripper bottoms portion to a fractionation zone;

collecting a fractionation zone bottoms portion containing at least ninety-nine mole percent of the hydrocarbons heavier than methane entering the fractionation zone;

collecting a fractionation zone overheads portion comprising mostly methane;

separating a hydrogen stream containing more than ninety mole percent hydrogen from at least one of the plurality of chilling stages operated at a temperature lower than −140° C.;

separating a hydrogen bleed stream from the hydrogen stream;

combining the hydrogen bleed stream with the fractionation zone overheads portion to form a chilled fractionation zone overheads portion; and collecting a methane stream from the chilled fractionation zone overheads portion.

14. A process as recited in claim 13 wherein the fractionation zone overheads portion contains less than one mole percent of the hydrocarbons heavier than methane contained in the gas mixture and less than three percent hydrogen; the fractionation zone bottoms portion contains less than 1000 ppm wt. methane, less than 100 ppm wt. hydrogen and less than 100 ppm wt. carbon monoxide; and the hydrogen stream contains at least ninety percent of the hydrogen contained in the gas mixture passed through the plurality of chilling stages.

15. A process for separating hydrogen and methane from a gas mixture containing heavier hydrocarbons, said process comprising the steps of:

providing the option of precluding the need to utilize an external methane refrigeration circuit by, passing the mixture through a plurality of chilling stages;

collecting a first bottoms portion from at least one chilling stage;

passing the first bottoms portion to a hydrogen stripper;

collecting a hydrogen stripper overheads portion containing at least ninety percent of the hydrogen entering the hydrogen stripper;

collecting a hyrogen stripper bottoms portion which comprises at least seventy percent of the methane entering the hydrogen stripper;

passing the hydrogen stripper bottoms portion to a fractionation zone;

collecting a second bottoms portion from at least one of the plurality of chilling stages;

passing the second bottoms portion to the fractionation zone;

collecting a fractionation zone bottoms portion comprising at least ninety-nine mole percent of the hydrocarbons heavier than methane entering the fractionation zone;

collecting a fractionation zone overheads portion comprising mostly methane and;

collecting a hydrogen stream at least one chilling stage operated at a temperature lower than −140° C.

16. A process as recited in claim 15 wherein the fractionation zone overheads portion is passed through a heat exchange zone in which the methane stream is collected.

17. A process as recited in claim 15 wherein each successive stage of the plurality of chilling stages is operated at a temperature which is lower than the temperature of the chilling stage which preceded it.

18. A process as recited in claim 15 wherein the first bottoms portion is collected from at least the first chilling stage of the plurality of chilling stages.

19. A process as recited in claim 15 wherein the hydrogen stripper overheads portion is passed to a chilling stage at a colder temperature than the coldest chilling stage from which the first bottoms portion was taken.

20. A process as recited in claim 15 wherein the hydrogen stream is collected from the chilling stage of lowest temperature.

21. In a process for separating hydrogen and methane from a gas mixture having hydrocarbons heavier than methane in which the mixture is passed through a plurality of chilling stages, each successive chilling stage being colder than the one preceding it, a bottoms portion and overheads portion being collected from at least one of the chilling stages, the bottoms portion being passed to a fractionation zone, the overheads portion being passed to a hydrogen separator, collecting a fractionation zone bottoms portion comprising substantially all of the hydrocarbons heavier than methane entering the fractionation zone, and collecting a methane rich stream from the fractionation zone, the improvement comprising the steps of:

providing the option of precluding the need to utilize an external methane refrigeration circuit by, collecting a bottoms portion from at least one chilling stage;

passing the bottoms portion from at least one chilling stage to a hydrogen stripper;

collecting a hydrogen stripper bottoms portion comprising at least seventy percent of the methane entering the hydrogen stripper;

passing the hydrogen stripper bottoms portion to the fractionation zone;

collecting a hydrogen stripper overheads portion containing most of the hydrogen entering the stripper;

passing the hydrogen stripper overheads portion to a chilling stage at a lower temperature than the coldest chilling stage from which the bottoms portion passed to the hydrogen stripper was taken;

collecting a methane stream from the fractionation zone overheads portion; and collecting a hydrogen stream from a chilling stage of a temperature lower than −140° C.

* * * * *

UNITED STATES PATENT AND TRADEMARK OFFICE

CERTIFICATE OF CORRECTION

PATENT NO. : 4,629,484

DATED : December 16, 1986

INVENTOR(S) : Henry Z. Kister

It is certified that error appears in the above-identified patent and that said Letters Patent are hereby corrected as shown below:

In Claims 1, 9, 13; lines 4 and 5 thereof and in Claim 21 lines 20 and 21 thereof delete: "providing the option of precluding the need to utilize an external methane refrigeration circuit by,".

Signed and Sealed this

Eleventh Day of August, 1987

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,629,484

DATED : December 16, 1986

INVENTOR(S) : Henry Z. Kister

It is certified that error appears in the above-identified patent and that said Letters Patent are hereby corrected as shown below:

In Claim 15, Col. 11, lines 1 and 2 delete:

"providing the option of precluding the need to utilize an external methane refrigeration circuit by,".

Signed and Sealed this

Twenty-second Day of September, 1987

*Attest:*

DONALD J. QUIGG

*Attesting Officer* *Commissioner of Patents and Trademarks*